US005472479A

United States Patent [19]

Ahlborg

[11] Patent Number: 5,472,479

[45] Date of Patent: Dec. 5, 1995

[54] METHOD OF MAKING ULTRA-LOW CARBON AND SULFUR STEEL

[75] Inventor: Kevin C. Ahlborg, Richfield, Ohio

[73] Assignee: LTV Steel Company, Inc., Cleveland, Ohio

[21] Appl. No.: 186,906

[22] Filed: Jan. 26, 1994

[51] Int. Cl.[6] ..... C21C 7/10

[52] U.S. Cl. ..... 75/508

[58] Field of Search ..... 75/508, 510

[56] References Cited

U.S. PATENT DOCUMENTS

| | | | |
|---|---|---|---|
| 2,253,421 | 8/1941 | Demare . | |
| 2,457,055 | 12/1921 | Loveless . | |
| 3,297,434 | 1/1967 | Littmann et al. . | |
| 3,695,946 | 10/1972 | Demeaux | 75/508 |
| 3,867,211 | 2/1975 | Easton . | |
| 3,925,061 | 12/1975 | Carlsson et al. . | |
| 4,564,390 | 1/1986 | Gupta et al. . | |
| 5,304,231 | 4/1994 | Kato et al. | 75/510 |

FOREIGN PATENT DOCUMENTS

| | | |
|---|---|---|
| 0124689 | 11/1984 | European Pat. Off. . |
| 0146696 | 7/1985 | European Pat. Off. . |
| 0548868 | 6/1993 | European Pat. Off. . |
| 5115911 | 3/1979 | Japan . |
| 3210237 | 2/1987 | Japan . |
| 3028320 | 6/1989 | Japan . |
| 4318118 | 3/1993 | Japan . |
| 431235 | 8/1970 | U.S.S.R. . |
| 433220 | 4/1972 | U.S.S.R. . |
| 1123275 | 8/1968 | United Kingdom . |
| 1293411 | 10/1972 | United Kingdom . |

OTHER PUBLICATIONS

Hatakeyana et al., *Develpment of a New Secondary Refining Process Using an RH Vacuum Degasser,* Jul. 1989 I & SM pp. 23–29.

*Performance Specification Level II Software LFT/VTD,* Messo Metallurgie, 25, Feb. 1991, p. 2.

Endoh et al., *Development of Multifunctional Secondary Refining Process (RH–Injection Process)*, Nippon Steel Technical Report, No. 45 Apr. 1990, pp. 23–28.

*Primary Examiner*—Melvyn Andrews

*Attorney, Agent, or Firm*—Watts Hoffmann Fisher & Heinke

[57] ABSTRACT

A method of making ultra-low carbon, ultra-low sulfur content steel comprising introducing molten metal and slag into a vacuum decarburizer to reduce the carbon content of the metal to below 0.005%, followed by deoxidizing the molten steel, deoxidizing the slag and mixing the slag with the molten steel to reduce the sulfur content to below 0.005%.

22 Claims, No Drawings

METHOD OF MAKING ULTRA-LOW CARBON AND SULFUR STEEL

BACKGROUND OF THE INVENTION

This invention is directed to a method of producing steels having an ultra-low carbon and ultra-low sulfur content which are suitable for use as electrical steels, and more particularly as motor lamination steels (MLS).

For many uses, such as motor lamination, today's electrical steels must be of a high grade, with residual elements such as carbon, sulfur and nitrogen being significantly eliminated from the steel. A reduction in the carbon content helps to prevent or limit the effects of magnetic aging and lowers core loss. The reduction of sulfur in the steel helps to eliminate MnS inclusions, thereby improving core loss. Thus, the chemistries for MLS and other high grade electrical steels are ideally characterized by ultra-low carbon and sulfur contents of less than about 0.005% each.

Typically, ultra-low carbon processing involves refining in a basic oxygen furnace (BOF) followed by vacuum decarburization to ultra-low carbon levels. As is known in the art, basic-oxygen processes typically involve the charging of molten iron, steel scrap and other components for the formation of the liquid steel into a metallurgical vessel and blowing a high velocity stream of oxygen from a lance into the molten ferrous starting materials to refine them into steel. The details of basic oxygen processes in general, and of the Basic Oxygen Furnace (BOF) in particular, are well known to those of ordinary skill in the art.

Similarly, as is known in the art of manufacturing ultra-low carbon steels, the carbon content of the melt is typically reduced to ultra-low levels by a vacuum circulation process (VCP) in a so called vacuum degasser. In the vacuum decarburization process the melt is introduced into a low pressure environment so that carbon and oxygen are evolved out of the melt as gaseous reaction products such as carbon monoxide. Inert gas is introduced into the melt, typically through tuyeres submerged in the bath, to reduce the partial pressure of the CO and to agitate and stir the bath. An important concern in the manufacture of ultra-low carbon steels is the problem of carbon pick-up after satisfactory carbon levels have been obtained. Carbon-bearing materials such as alloying agents, slag deoxidants, ladle refractories and graphite electrodes used in the ladle furnace can contaminate the steel, making it difficult to maintain the required ultra-low carbon levels. Accordingly, it has been the practice to avoid further processing after decarburization to ultra-low levels, and to cast the steel into solid shapes as soon as possible after decarburization.

Desulfurization is typically carried out in a ladle prior to vacuum decarburization in order to avoid additional processing and associated carbon pick-up after degassing. Occasionally, desulfurization is carried out subsequent to deoxidation, but while the melt is still under vacuum in a degassing vessel. These processes typically involve the introduction of a desulfurizing reagent or flux into the molten metal charge to remove the sulfur from the steel. Since many of the components of the ladle slag such as FeO and MnO are deleterious to the desulfurization process, it is usually desirable to keep the ladle slag from intermixing with the molten metal being refined unless the slag is treated or replaced with an artificial slag that will not hinder the desulfurization process. Moreover, to conduct both decarburization and desulfurization while under vacuum, the apparatus must be constructed to enable the desulfurizing flux to be injected during the vacuum process.

The present invention provides a method of producing ultra-low carbon, ultra-low sulfur steel which advantageously avoids the need for costly desulfurizing reagents. Its ability to utilize a conventional ladle furnace for desulfurization avoids the need for the complex apparatus necessary to enable simultaneous vacuum circulation and desulfurization. The particular order of the inventive processing steps renders the inventive method particularly useful in continuous casting operations, and the effects of carbon pick-up after decarburization can be controlled.

DISCLOSURE OF THE INVENTION

The instant method advantageously performs the desulfurization step in a conventional ladle furnace after vacuum decarburization has been completed using carry-over BOF slag as the principal desulfurizing agent. This enables desulfurization in conventional facilities without disruption of the normal sequence of the charge as it proceeds through a continuous casting process. Surprisingly, the threat of carbon pick-up does not significantly affect the ability to maintain the ultra-low carbon levels. By employing a multi-step process wherein the melt is vacuum decarburized, followed by deoxidation of the steel, ladle slag deoxidation and steel desulfurization, the inventive method provides an effective and economical means of consistently obtaining ultra-low carbon, ultra-low sulfur steel without the need for complex specialized apparatus, desulfurizing powder fluxes, removal of carry-over slag or avoidance of ladle slag agitation. This is a significant advantage over previous desulfurization processes which decarburize after desulfurization or where both are conducted under vacuum and require the addition of desulfurizing fluxes, replacement of carry-over slag, or careful avoidance of slag agitation.

After basic oxygen processing the melt comes out of the BOF with an oxygen content on the order of 600 ppm and a carbon content on the order of 0.02–0.03%. In order to reduce the carbon content to ultra-low levels of less than 0.005%, the charge is then subjected to vacuum decarburization in a vacuum degasser. In the inventive process the slag from the BOF processing, so called carry-over slag, is not removed. This provides good insulation and facilitates decarburization due to the extreme oxidizing nature of the carry-over slag. During the vacuum decarburization process the carbon content of the melt drops to below 0.005% and the oxygen content drops typically to below about 400 ppm. After degassing, the melt is deoxidized by the addition of, for example, metallic aluminum and/or silicon, which takes the oxygen content down to about 3 ppm or less. In the preferred embodiment, once the melt has been decarburized and deoxidized, it is taken to a conventional ladle furnace for desulfurization.

At the ladle furnace it is important that the highly oxidized ladle slag is transformed to a reducing state in order for it to desulfurize the melt. The slag is transformed to a reducing slag by melting the slag, for example by electric arc heating, and then adding ladle slag deoxidants. Suitable ladle slag deoxidants include, for example, metallic aluminum, metallic calcium, silicon and the like. Although the preferred deoxidant is aluminum, one of the reasons this process is especially effective for motor lamination steels is because of the high silicon content associated with these steel grades.

The effectiveness of the desulfurization increases as the FeO and MnO content of the slag decreases. The presence of MnO and especially FeO in the slag is deleterious to the desulfurization process. The aluminum in the slag deoxidant reacts with FeO and MnO in the slag to form $Al_2O_3$ which enables metallic Fe and Mn to be precipitated out of the slag and into the molten steel. Thereafter CaO in the slag can dissociate and effectively act as a sulfur scavenger. Naturally, the higher the FeO content of the slag, the more ladle slag deoxidant should be added. The object is to get both the FeO and MnO content of the slag as low as possible, preferably to below about 1.0% so that the combined FeO and MnO content is below about 3%, whereafter efficient sulfur uptake by the slag can take place. Since the calcium scavenges the sulfur while the aluminum takes up the oxygen from the FeO and MnO, the ratio of these components is also important. The ratio of CaO to $Al_2O_3$+$SiO_2$ in the slag, which is a measure of the slag basicity, should be between about 1.0 and 2.5, preferably 1 to 1.5. Typically, the adjustment of the slag basicity will for the most part be accomplished with artificial slag.

The preferred ladle slag deoxidant is metallic aluminum, which can comprise from about 25% to 100% of the slag deoxidant composition. Metallic aluminum can be highly explosive when finely divided. Thus, when seeking to employ high percentages of aluminum as the deoxidant, coarser grades such as aluminum shot should be used to avoid explosions. When using finer grades of aluminum, it is desirable to pacify it with filler. A preferred filler for the slag deoxidant is burnt lime. Thus, for safety reasons, the aluminum should not exceed about 32% of the slag deoxidant composition when finer grades are used. The balance of the composition can be burnt lime. In the instant method a preferred ladle slag deoxidant consists of about 32% metallic aluminum and 68% burnt lime which is added in an amount ranging from about 5.5 and 12.7 pounds per ton of steel. This will work out to about 1500–3500 lbs of slag deoxidant for a typical batch size of between about 255 to 310 tons.

If desired, synthetic or artificial slag can be added to the carry-over slag at BOF tap. This can facilitate the desulfurization process by adjusting slag basicity. A typical synthetic slag may comprise dicalcium aluminate, dolomitic lime and burnt lime. A particularly preferred synthetic slag will include the foregoing components in the amounts of about 32%, 18% and 50% respectively.

The deoxidized ladle slag is stirred into the melt by bubbling argon gas through the melt. The stirring reduces the FeO and MnO resulting in metallic Fe and Mn being precipitated from the slag into the steel thereby rendering the slag capable of removing sulfur from the bath. A short stir of about 15 minutes with the argon after slag deoxidation is sufficient to remove 50% or more of the sulfur, taking the steel to ultra-low sulfur levels of below about 0.005%.

In accordance with the foregoing, the present invention provides a method of making ultra-low carbon, ultra-low sulfur content steel from a charge comprising a quantity of molten ferrous metal and slag, the method comprising introducing the molten metal and slag into a low pressure environment to reduce the carbon content of the metal, deoxidizing the molten metal, deoxidizing the slag and mixing said slag with the molten metal to reduce the sulfur content of the molten metal. Preferably, the step of deoxidizing the molten metal comprises adding metallic aluminum thereto, and more preferably, both metallic aluminum and silicon. The slag deoxidant is preferably metallic aluminum, and still more preferably, the slag deoxidant comprises about 68% burnt lime and about 32% metallic aluminum. In still another preferred embodiment, the method comprises adding additional slag to the molten metal.

Many additional features, advantages and a fuller understanding of the invention will be had from the following detailed description of preferred embodiments.

DETAILED DESCRIPTION OF THE PREFERRED EMBODIMENTS

A batch of steel is prepared for vacuum decarburization in the conventional manner by refining scrap and blast furnace iron in a conventional BOF. A scrap-based operation using an electric arc furnace could also provide suitable starting materials provided the scrap charge is of good quality. A typical batch size may range from 255 to 310 tons. The temperature prior to processing is typically about 2900° F., with an aim range of about 2880° to 2920° F. The steel arriving at the vacuum degasser for subsequent use in high grade motor lamination or other electrical steel applications will typically have a chemistry of less than about 0.05% carbon, less than 0.40% manganese, less than about 0.02% sulfur, less than about 0.01% silicon, less than about 0.002% aluminum and more than about 450 ppm oxygen. To achieve a low carbon content in the final product it is necessary to start the process with a dissolved oxygen content which exceeds the dissolved carbon content. Having excess oxygen in the bath speeds the decarburization steps and improves process efficiency. Accordingly, it is desirable to limit the content of elements such as aluminum, silicon and manganese in the initial steel charge which have a high affinity for oxygen. Ideally, there should be no measurable amounts of aluminum or silicon at this stage, and the manganese content should be below about 0.2%.

The ladle is covered by slag to a depth of about two to ten inches to provide insulation. Although the ultimate ladle slag volume is not routinely measured, the total slag weight can be estimated by calculating an aluminum mass balance. Using this method, it is estimated that the slag volume is approximately 32.7 pounds per ton of steel, and should normally range between about 29.1 to 43.6 pounds per ton of steel. Thus, in a typical heat of 255 to 310 tons, the slag volume will range between about 8,000 to 12,000 pounds.

The oxygen potential of the slag must be compatible with that of the steel bath. Insufficient oxygen in the slag will result in the absorption of FeO from the steel, which reduces the amount of oxygen which is immediately available for steel decarburization. Therefore, it is necessary in the inventive process to start with a ladle slag having a high oxygen potential, which can be expressed in terms of the FeO content of the slag.

The slag originates from a combination of slag carried over from the melting furnace, so called "carry-over" slag, and additional artificial slag which may be added at BOF tap if desired. The formulation of the synthetic slag is adjusted to provide a final slag condition which is most favorable for desulfurization and efficient ladle furnace operation. The ratio of CaO%/$(Al_2O)_3$%+$SiO_2$%), or slag basicity, is an important parameter of the final slag composition. A high basicity favors sulfur absorption from a capacity standpoint, but results in a viscous slag and sluggish reaction kinetics. A low basicity results in a fluid slag condition with good reaction kinetics, but poor sulfur scavenging capacity. Ideally, the slag basicity is near 1.1 at the commencement of the desulfurization step. Highly basic ladle slags which are fluidized with calcium fluoride ($CaF_2$ or fluorspar) are frequently used in the industry to desulfurize steel. However, calcium fluoride is corrosive and deleteriously affects ladle refractories. Advantageously, the slags according to the invention do not use calcium fluoride. Suitable artificial or synthetic slags may be comprised of dolomitic lime, burnt lime and dicalcium aluminate. A particularly useful artificial slag according to the invention may comprise the foregoing ingredients in amounts of about 18%, 50% and 32% respectively.

The amount of BOF slag is not closely controlled, but typically may average about 16.2 pounds per ton of steel. Thus, the artificial slag should be added to bring the total slag amount to within the preferred range of 29.1 to 43.6 pounds per ton. In a typical heat about 10.9 pounds of artificial slag per ton of steel will suffice. The overall ladle slag composition prior to vacuum decarburization should contain from about 35% to 55% CaO, 0% to 18% $SiO_2$, 10% to 50% FeO, 0 to 10% MnO, 3% to 15% MgO, 0% to 1.5% $P_2O_5$, 0% to 0.2% S and 0% to 25% $Al_2O_3$. More preferably, the slag should contain about 42 to 50% CaO, 5 to 12% $SiO_2$, 15% to 25% FeO, 0 to 5% MnO, 5% to 15% MgO, 0% to 1.5% $P_2O_5$, 0% to 0.1% S and 4% to 12% $Al_2O_3$.

The melt is then decarburized in the conventional manner until the carbon content of the steel is no more than about 0.005%. Preferably, the decarburization is conducted in a circulating-type vacuum degasser at pressures below about 1 torr. The aim carbon content after decarburization is 0.001% to 0.002%, or 10 to 20 ppm.

The rate of CO evolution during the vacuum decarburization process is measured. When the evolution of CO gas from the steel bath decreases to a predetermined rate, the decarburization process is deemed practically complete; and the steel is deoxidized, which stops the formation and evolution of CO bubbles. Suitable deoxidants for this phase of the inventive process include metallic aluminum, silicon, manganese, and alloys of aluminum, calcium, manganese, silicon and zirconium. Metallic aluminum is preferred and may be added to the melt in amounts in excess of about 4.4 pounds per ton of steel. Of course, the amount of aluminum to be added is grade dependent. Higher steel grades will have a higher aluminum content. However, for the MLS steels of particular interest here, the aluminum should be added in amount of between about 5.4 and 7.3 pounds per ton of steel. Silicon is also a good deoxidant and can be used in conjunction with the aluminum. When silicon is used in conjunction with aluminum it is preferably added in the form of 70% ferrosilicon in an amount of about 10.5 pounds per ton of steel. As with the aluminum, desired silicon content is also grade dependent. In the case of the MLS grades of particular interest here, ferrosilicon will be added in amounts ranging from about 8.5 to 12.8 pounds per ton, although it could go as high as 32 pounds per ton for some exotic steel grades. It is also normal to add manganese at this time, although not necessary to the process. In the preferred process the deoxidants are added to the steel while it is still being circulated through the VCP vessel. Advantageously this provides, among other things, a strong mixing force to ensure efficient deoxidation.

Next, the melt it transferred to a conventional ladle furnace for desulfurization processing. One reason why the ability of the inventive process to utilize the ladle furnace for desulfurization is particularly advantageous is because the typical ladle furnace is capable of increasing the temperature of the steel by electric arc heating and has equipment for adding alloys, cooling scrap and other materials which may be desirable in the final product. Upon arrival at the ladle furnace, the ladle slag must be deoxidized in order for it to be capable of absorbing sulfur from the steel bath. Although preferable, it is not necessary to the invention to deoxidize the steel prior to slag deoxidation.

The slag and steel bath surface is heated with the electric arcs, typically for about 4 to 10 minutes, consuming on the order of 1600 KWH's or more of power. The purpose of this step is to fluidize the slag. The process can be prolonged or shortened depending on the condition of the ladle slag upon arrival. A slag deoxidant consisting of burnt lime and metallic aluminum is added to the fluidized slag and mixed in by argon bubbling. A preferred ladle slag deoxidant contains between about 25 to 32% metallic aluminum and the balance burnt lime. Other slag deoxidants suitable for use in the instant method would be known to those of ordinary-skill in the art in view of the instant disclosure. For example, if coarser aluminum grades such as aluminum shot are used, the dangers of explosion are reduced and 100% metallic aluminum may be used effectively by itself, or other aluminum bearing reagents may be used.

Sufficient ladle slag deoxidant should be added to bring the combined FeO and MnO content of the slag to below about 3%. Preferably, the FeO and MnO contents should each be taken to below about 1%. Typical amounts of deoxidant that would be added are about 5.5 and 12.7 pounds per ton of steel, or 0.28 pounds slag deoxidant per pound of slag. In a normal run about 2500 pounds of slag deoxidant will be added. This will provide sufficient aluminum to bring the ratio of CaO to $Al_2O_3$+$SiO_2$ in the slag, i.e., slag basicity, to between about 1.0 to 2.5, more preferably 1.0 to 1.5. Although the burnt lime in the slag deoxidant will contribute to the value of the slag basicity, the principle adjustment of slag basicity is accomplished by the artificial slag.

After treatment the slag should contain from about 30% to 62% CaO, 0% to 20% $SiO_2$, 0% to 2.0% FeO, 0 to 1.0% MnO, 5.0% to 15% MgO, 0% to 1.0% $P_2O_5$, 0% to 1.0% S and 20% to 40% $Al_2O_3$. More preferably, the slag should contain about 40 to 50% CaO, 0 to 15% $SiO_2$, 0% to 1.0% FeO, 0 to 0.5% MnO, 5% to 15% MgO, 0% to 0.15% $P_2O_5$, 0% to 1.0% S and 30% to 40% $Al_2O_3$.

Upon stirring the bath and slag with inert gas bubbling, the Fe and Mn are precipitated from the slag rendering it capable of absorbing sulfur from the bath. Circulation of the steel bath is essential, and is preferably accomplished by argon bubbling at or near the bottom of the ladle. Argon bubbles are injected either through a stir plug inserted into the ladle refractories, or through a refractory coated pipe inserted into the steel bath through the top of the ladle. The slag deoxidation step is essentially completed in about 8 minutes, during which time the ladle slag FeO content drops from an average level of about 24% to below 3%. Continuous stirring through the desulfurization process results in a further lowering of the ladle slag FeO content to an average level of about 1%.

Argon bubbling results in emulsification of the slag and steel and promotes mass transfer of sulfur from the steel to the slag. The slag accepts and retains sulfur provided it has an appropriate basicity as described above and a low oxygen potential. The oxygen potential, represented mainly by the slag FeO content, and to a lesser extent by the slag MnO content, indicates whether calcium oxide can readily disassociate so that calcium atoms can capture sulfur atoms. The slag begins to absorb significant amounts of sulfur once the sum of the FeO and MnO contents falls below about 3%.

The rate of sulfur removal is dependent upon the intensity of the bubbling used to emulsify the slag with the steel. In the event that the sulfur content of the steel is already low prior to treatment, then the intensity of bubbling may be kept low and sulfur removal will not be significant, e.g., less than about 25%. Heats entering the process with a high sulfur content can be bubbled more intensely. As much as 80% of the sulfur has been removed during the course of a 55 minute treatment at the ladle furnace. Typically, a 15 minute stir with the sulfur removing slag is sufficient to remove on the order of 50% or more of the sulfur and take the steel chemistry down to ultra-low sulfur levels of 0.005% or less. During the stirring period, the operator typically completes the alloying of the steel by making further additions to the bath, and adjusts the temperature of the steel either by arc heating or by adding coolant scrap. While not required in the primary treatment process, calcium can also be added during the stirring period to accelerate the desulfurization process. When desired, the calcium may be added in amounts of between about 0.6 to 2.0 pounds per ton of steel.

These and other aspects of the preferred embodiments will be apparent from the following non-limiting example.

EXAMPLE

A 269 ton melt was transferred from the BOF to a circulating type vacuum degasser at the ladle metallurgy facility for vacuum decarburization. The melt was covered with ladle slag on arrival. The slag consisted of 42.8% CaO, 15.4% $SiO_2$, 23.6% FeO, 4.4% MnO, 8.5% MgO, 3.1% $Al_2O_3$, 0.6% P and 0.1% S. The temperature of the melt upon commencement of vacuum decarburization was 2902° F. The oxygen content of the melt was 630 ppm and the carbon content was about 0.025%. The decarburization lasted about 20 minutes at a degasser pressure atmosphere of about 1–3 torr with argon bubbling between 72 and 81 standard cubic feet per minute (SCFM). During decarburization the temperature dropped to about 2862° F., the carbon content was taken down to approximately 0.004% and the oxygen content went essentially to zero. After decarburization, the steel was deoxidized with the addition of approximately 5.6 pounds of aluminum shot per ton of steel, and 10.8 pounds of 70% ferrosilicon per ton of steel.

The melt was then taken to the ladle furnace for heating and slag deoxidation. The slag was fluidized by electric arc heating for approximately 5 minutes consuming approximately 7.25 KWH of power per ton. Next, 3098 pounds of slag deoxidant consisting of 32% metallic aluminum and 68% burnt lime was added to the slag while stirring with argon bubbling at approximately 10 SCFM for 4 minutes. After treatment the slag consisted of 54.3% CaO, 6.6% $SiO_2$, 1.5% FeO, 0.9% MnO, 11.2% MgO, 27.3% $Al_2O_3$, 0.1% P and 0.2% S. The slag and melt were mixed by argon bubbling at between about 4 to 10 SCFM for 31 minutes, while final alloy additions were made. The final product comprised 0.0045% carbon, 0.004% sulfur, 0.38% Si, 0.53% Mn, 0.304% Al, and the balance various alloying agents required for the final product grade.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of making ultra-low carbon, ultra-low sulfur content steel from a charge comprising a quantity of molten ferrous metal, which contains carbon, sulfur and oxygen, and slag, said method comprising:

a) introducing said molten metal and slag into a low pressure environment to reduce the carbon content of the metal;

b) deoxidizing said molten metal;

c) deoxidizing said slag; and, d) mixing said deoxidized slag with said deoxidized molten metal to reduce the sulfur content of said molten metal.

2. The method according to claim 1 wherein the step of deoxidizing said molten metal comprises adding metallic aluminum to said molten metal.

3. The method according to claim 1 wherein said molten metal is deoxidized after removing said low pressure environment.

4. The method according to claim 1 wherein said steps of deoxidizing said slag and mixing said deoxidized slag with said molten metal are conducted in a ladle furnace.

5. The method according to claim 1 where the step of deoxidizing said slag comprises adding metallic aluminum to said slag.

6. The method according to claim 5 comprising adding said metallic aluminum in combination with burnt lime.

7. The method according to claim 5 wherein said slag contains FeO and MnO and during the step of deoxidizing said slag sufficient aluminum is added to said slag to bring the combined FeO and MnO content of said slag to below about 3% by weight based on the weight of said slag.

8. The method according to claim 1 comprising mixing said slag deoxidized with said molten metal until a sulfur content of said deoxidized molten metal is no greater than 0.005% by weight based on the weight of said deoxidized molten metal.

9. The method according to claim 1 wherein said molten metal is maintained in said low pressure environment until a carbon content of said molten metal is reduced to no more than about 0.005% by weight based on the weight of said molten ferrous metal.

10. The method according to claim 9 wherein said additional slag is added to said molten metal prior to introducing said molten metal to low pressure environment.

11. The method according to claim 1, wherein the step of mixing said deoxidized slag is carried out in an ambient pressure environment.

12. The method according to claim 1, further comprising the step of fluidizing said slag prior to the step of deoxidizing said slag.

13. The method according to claim 1, wherein the step of mixing said deoxidized slag is carried out in a ladle furnace.

14. A method of making ultra-low carbon, ultra-low sulfur content steel from a charge comprising a quantity of molten ferrous metal, which contains carbon, sulfur and oxygen, and slag, said method comprising:

a) introducing said molten metal and said slag into a low pressure environment and maintaining said molten metal and said slag in the low pressure environment at least until the carbon content of the metal is reduced to below about 0.005% by weight based on the weight of the molten metal;

b) deoxidizing said molten metal;

c) deoxidizing said slag; and, d) mixing said deoxidized slag with said deoxidized molten metal until the sulfur content of said deoxidized molten metal is below about 0.005% by weight based on the weight of said deoxidized molten metal.

15. The method according to claim 14 wherein the step of deoxidizing the molten metal comprises adding metallic aluminum to said molten metal in an amount of at least about 4.4 pounds per ton of molten metal.

16. The method according to claim 14 wherein said step of deoxidizing said molten metal is conducted after said low pressure environment has been eliminated.

17. The method according to claim 14 wherein said steps of deoxidizing said slag and mixing said slag with said deoxidized molten metal are conducted in a ladle furnace.

18. The method according to claim 14 wherein said step of deoxidizing said slag comprises melting said slag and adding metallic aluminum to said slag.

19. The method according to claim 18 comprising adding said metallic aluminum as part of a composition comprising metallic aluminum and burnt lime, said metallic aluminum comprising between about 25 to 32% by weight of said composition based on the combined weight of said burnt lime and metallic aluminum, and said composition being added to said slag in amount of between about 5.5 to 12.7 pounds per ton of molten metal.

20. The method according to claim 14 wherein additional slag is added to said molten metal prior to introducing said molten metal to said low pressure environment.

21. The method according to claim 15 further comprising adding 70% ferrosilicon in an amount of between about 8.5 to 12.8 pounds per ton of molten metal.

22. A method of making ultra-low carbon, ultra-low sulfur content steel from a charge comprising a quantity of molten ferrous metal, which contains carbon, sulfur, and oxygen, and slag, said method comprising:

a) introducing said molten metal and slag into a low pressure environment to reduce the carbon content of the metal;

b) deoxidizing said molten metal;

c) deoxidizing said slag; and d) after the carbon content of the metal has been reduced, mixing said deoxidized slag with said deoxidized molten metal to reduce the sulfur content of said deoxidized molten metal.

* * * * *